US006691723B2

(12) United States Patent
Godbersen

(10) Patent No.: US 6,691,723 B2
(45) Date of Patent: Feb. 17, 2004

(54) CANOPY SIDE FRAME ADJUSTMENT UNIT

(76) Inventor: Byron L. Godbersen, Lake LaJune Estates, Ida Grove, IA (US) 51445

( * ) Notice: Subject to any disclaimer, the term of this patent is extended or adjusted under 35 U.S.C. 154(b) by 52 days.

(21) Appl. No.: 10/064,096

(22) Filed: Jun. 11, 2002

(65) Prior Publication Data

US 2003/0226587 A1 Dec. 11, 2003

(51) Int. Cl.[7] ..... E04H 15/34; E04H 15/64

(52) U.S. Cl. ..... 135/123; 135/120.2; 135/907; 52/222

(58) Field of Search ..... 135/123, 120.2, 135/142, 88.01, 907; 52/222; 114/361, 201 R

(56) References Cited

U.S. PATENT DOCUMENTS 757,175 A * 4/1904 Burland
3,025,866 A * 3/1962 Cockrum
5,421,273 A * 6/1995 Lin
5,444,943 A * 8/1995 Schelfhorst
6,349,666 B1 * 2/2002 Hastings

OTHER PUBLICATIONS

8–page –brochure entitled Owners Manual—Aluminum Canopy Frame For Steel Model SSF241S for the SSV45120 by Midwest Industries, Inc.

* cited by examiner

*Primary Examiner*—Robert Canfield
(74) *Attorney, Agent, or Firm*—Sturm & Fix LLP

(57) ABSTRACT

Apparatus is disclosed herein for adjusting the length of a frame to fit a canopy tied onto and stretched over the frame. Each end of the frame includes a mounting bracket which is slid into an open end of a side tube with a friction fit. A sleeve is secured over the side tube with a flange engaging the outer end of the bracket. An adjusting nut and bolt engages both the flange and the bracket such that rotation of the nut against the flange causes the bracket to be moved axially within and of the side tube thereby lengthening the overall length of the frame relative to the canopy.

4 Claims, 7 Drawing Sheets

CANOPY SIDE FRAME ADJUSTMENT UNIT

BACKGROUND OF INVENTION

1. Field of the Invention

The present invention relates generally to an improved canopy assembly for pleasure boats. As the generally rectangular canopy may stretch or become taut due to wear, or is not a perfect fit for its framework, the present invention is directed to a unit at each of the four corners of the framework for ease of adjustability of the length of the framework to provide a tight fit of the canopy.

The canopy is usually of a rectangular shape which may be mounted on a rectangular framework to cover either a pleasure boat at rest in the water normally of a bay, lake or river, or to cover the boat supported by a boat lift or hoist. Due to the canopy being too short or too long, or varied in length due to normal usage in sun and rain, the canopy may not always be or stay at the dimension according to the best fit of the canopy over the framework.

The upper framework usually comprises a pair of elongated, straight side tubes mounted parallel to each other and joined at their outer ends by a pair of slightly curved end tubes of a shorter length than the side tubes and with a quartet of right angularly curved corner tubes interconnecting the four side and end tubes to form a rectangle. One end of each corner tube includes a bracket with a pair of spaced, circular spacer members which bracket is frictionally inserted into an adjacent outer end of a side tube such that the end tube—corner tube unit at each end of the framework retains the framework in a fixed condition.

The framework is then in a condition for attachment thereto of the canopy. At each end and on the sides of the canopy, extra length of the material may be provided, and with grommets attached across the canopy end and side edges whereby springs or bungee cords may be hooked to the grommets and wrapped about or otherwise connected to bow members attached across each framework end for thereby attaching and holding the canopy onto and over the upper framework.

The problem arises when it becomes necessary to adjust the length of the framework to accommodate the length of the canopy such that a proper fit of the framework with the cover is provided. One method of adjustment is to attempt to manhandle each corner tube more inwardly or outwardly of its respective side tube end; however, such manhandling is difficult to provide for slight adjustment of only an inch or so. As the width of this type of boat canopy assembly may be 13", for example, and as the side tubes may be of a 4"O.D., one can readily appreciate the size and nature of the equipment with which we are working.

One may envisage the bracket being of a structure to be secured within the side tube by an Allen screw or other type of bolt inserted through the side tube in such a manner to hold the bracket and thus the end framework in place until loosened; but again manual adjustment is still required. In some instances, to make certain the brackets do not come out of the side tubes, the latter are dented by hammers or the like, thereby rendering adjustment impossible.

Thus, a need exists for an improved apparatus for adjusting a pleasure boat canopy assembly to provide for a canvas cover which has either shrunk or too long to fit properly on its framework.

SUMMARY OF INVENTION

The present invention is directed to an improved apparatus for adjusting the length of a pleasure boat or like canopy framework to properly fit its canopy.

The apparatus is provided at each corner of a rectangular framework, the framework comprising basically a pair of side frame tubes and a pair of end frame tubes, with a quartet of corner tubes, right angularly formed, each corner tube interconnecting, respectively, an adjacent end of a side frame tube with an adjacent end of an end frame tube. To provide a frictional connection of each corner tube with a side frame tube, one end of each corner tube has a bracket member which is thrust into the outer end of the adjacent side frame tube.

The invention comprises a sleeve which embraces each outer end of each side frame tube, which sleeve is fastened securely to the side frame tube by one or more hose clamps, and which sleeve has a flange extended at right angles to the end of each side frame tube and held securely thereagainst. An adjusting bolt is passed through each flange and into contact with the adjacent bracket within the side frame tube, the bolt extended axially of the side frame tube.

An adjusting nut is threaded onto the bolt from outside the flange for easy access, whereby should the nut be rotated in one direction against the flange, a jack screw effect is produced upon the bracket such that the bracket is inched longitudinally and axially outwardly of the end of the side frame tube. By like adjustment of the adjusting bolt and nut arrangement on the opposite end corner of the framework, the end frame tube and corner tubes at one end of the framework may be moved outwardly as a unit thus lengthening that particular end of the framework.

Should a corner adjusting nut be rotated in an opposite direction, the respective bracket may be pushed further into the side frame tube until the adjusting nut engages the stationary bracket flange, whereby the overall length of the framework may be shortened, it being kept in mind that a substantially even adjustment of opposed end pairs of corner bracket units may be required.

An object of the present invention is to provide apparatus which is easily accessible by a hand tool for adjusting the length of a canopy covered framework to maintain a proper fit of the framework with the canopy.

Another object of the present invention is to provide an apparatus for adjusting the axial position of one tube slidably connected to another tube.

Yet another object of the present invention is to provide an apparatus inserted between and extended into one tube for axially moving the one tube relative to a second tube also inserted into the one tube.

Still another object of the invention is to provide an apparatus controlling axial movement between a pair of slidably connected tubes.

Another object of the invention is to provide an apparatus whereby a pair of slidably connected tubes can be axially moved relative to each other by rotation of a single adjusting bolt.

An additional advantage of the present invention is a provision of a pleasure boat canopy framework having slidably adjustable corner units for adjusting the length of the framework at one or both ends thereof by the use of a simple wrench or like tool.

These and further objects, features and advantages of the present invention will become apparent from the following detailed description wherein reference is made to the figures in the accompanying drawings.

BRIEF DESCRIPTION OF DRAWINGS

These and other attributes of the invention will become more clear upon a thorough study of the following description of the best mode for carrying out the invention, particularly when reviewed in conjunction with the drawings, wherein.

While the invention will be described in connection with the presently preferred embodiment, it will be understood that it is not intended to limit the invention to these embodiments. On the contrary, it is intended to cover all alternatives, modifications and equivalents as may be included in the spirit of the invention or as defined in the appended claims, specification or figures.

DETAILED DESCRIPTION

The present invention relates to a canopy assembly for protecting pleasure boats from rain, sun and wind. Such canopy assemblies are primarily comprised of a pair of side frame tubes which may be of some 4" in diameter, are elongated, straight and in this instance, hollow; a pair of elongated hollow U-shaped end tubes, with a center section slightly curved and with straight outer ends slidably inserted axially into an adjacent end of a side tube.

This conventional canopy assembly also is provided with a plurality of curved bow elements attached at each end to a side frame tube forming a bowed upper surface the framework over which a canopy is attached by a plurality of bungee cords and springs attached between grommets formed in the canopy edges, the bow elements, and the side end tubes. A bow element may also serve as the center section of a framework end tube.

The conventional canopy assembly includes further a tubular weldment bracket at each straight outer end which bracket includes at least one circular spacer member for insertion into the outer, open end of an adjacent side frame tube. The upper framework and canopy just described is mounted on a quartet of upright posts or legs, one leg at each corner of the framework for support therefore, with the legs supported at their bottom ends by horizontally secured beams.

Figure 1:
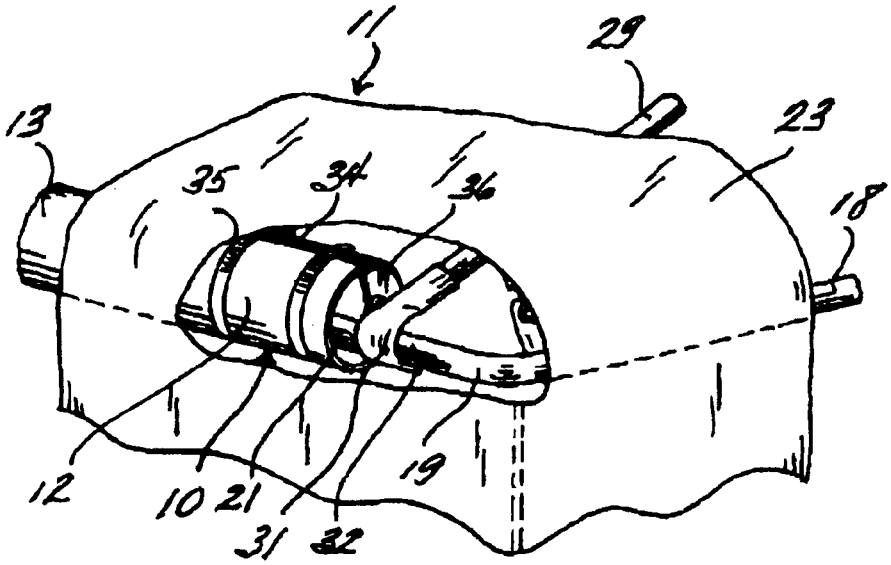
FIG. 1 is a perspective view of one of four corners of a pleasure boat framework, with a rectangular canopy covering the framework, taken from exterior the canopy and with a portion of the canopy cut away for clarity of illustration and showing the present invention.
Figure 2:
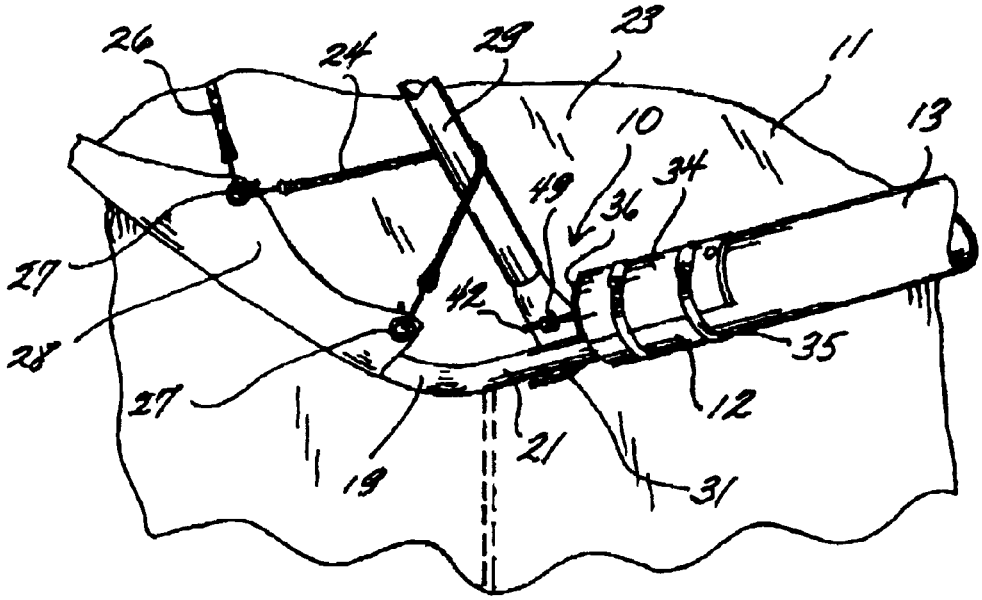
FIG. 2 is a perspective view of the corner of FIG. 1, taken from inside the framework, with no cutout.

Referring to FIGS. 1 and 2, one corner section (10) of a canopy assembly upper framework with a canopy (11) attached thereto is illustrated. An outer end (12) of an elongated, straight, hollow side frame tube (13) is depicted, into which a weldment tube outer end unit (14) is axially, slidably inserted. The weldment tube outer end unit (14) has, in this instance, a pair of longitudinally spaced, relatively flat, circular spacer elements (16), (17) secured thereto, which spacer elements (16), (17) have a diameter slightly less than the inner diameter of the side frame tube outer end (12), whereby the weldment tube outer end (14) and its spacer elements (16), (17) are axially slidable back and forth within the side frame tube outer end (12).

The outer tubular end (18) of a framework end tube is shown, connected to a curved tube (19), with the curved tube (19) attached to an adjacent end (21) of a weldment tube (22), thus forming a right angular corner section (10) of the upper framework of the canopy assembly. The tubes (21), (22) and spacers (16), (17) form the weldment tube outer end unit (14). The corner portion (23) of the canopy is shown, draped over the side frame tube (13), the end tube outer end (18) and associated connecting member. The portion is held down by bungee cords (24), (26) connected between grommets (27) formed along the edge (28) of the canopy portion (23), and a bow element (29), each bow element (29) having a curved outer end (31) welded in a clamped manner to a portion (32) of the weldment tube (22).

Although the tubular members described thus far are circular and hollow, their cross-sectional shapes may be varied from circular, and they need not be completely hollow so long as their mating relationships coact as described.

Figure 5:
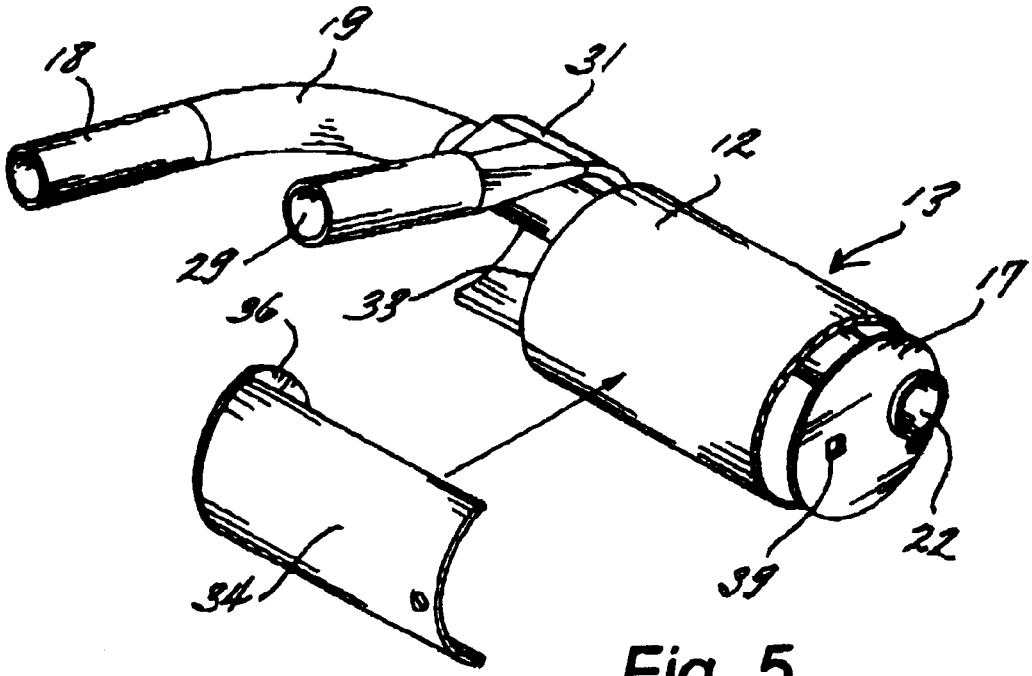
FIG. 5 is a perspective view similar to FIG. 3, and with all but a sleeve element assembled.

In practice, each framework end tube outer end (18) at each corner section (10) of the canopy assembly upper framework is slidably inserted into the adjacent outer end (12) of each side frame tube (13) until, for example, the clamping outer end (31) of a bow element (29) is closely adjacent to or even contiguous with the exposed face (33) (FIGS. 5 and 6) of the outer end (12) of a side frame tube (13).

Figure 4:
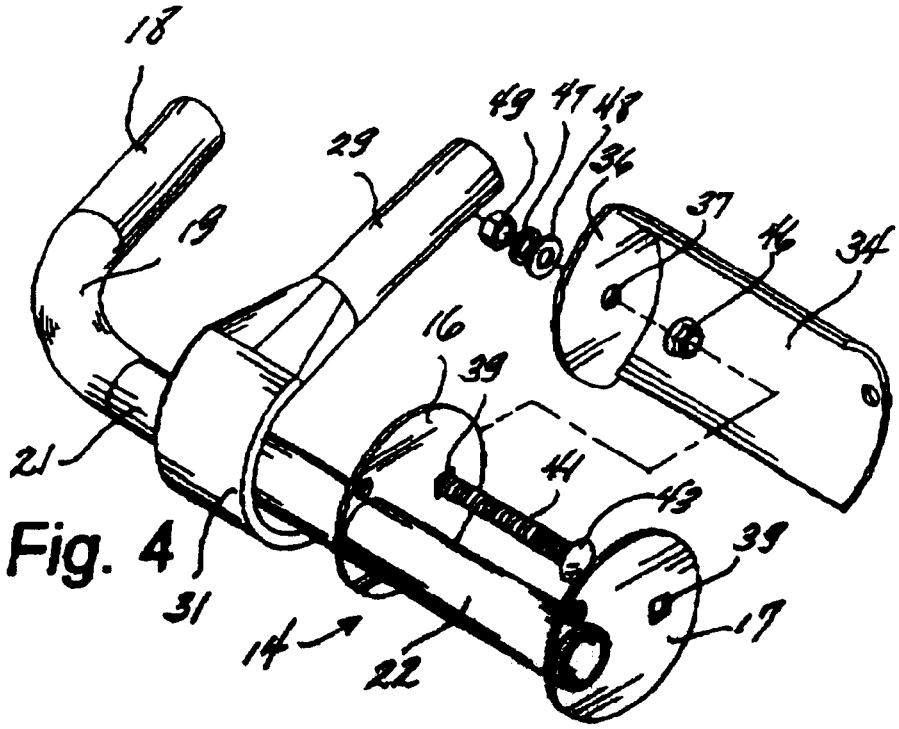
FIG. 4 is another enlarged exploded view of the present invention, from another perspective.

The improvement of this invention comprises a semicircularly curved sleeve (34) (FIG. 5) having a radius such that it can fit snuggly over the curved outer surface of the side frame tube outer end (12), and including further an oval shaped flange (36) (FIG. 4) extended at right angles to the longitudinal extent of the sleeve (34). An opening (37) (FIG. 4) is formed centrally within the flange (36).

Figure 6:
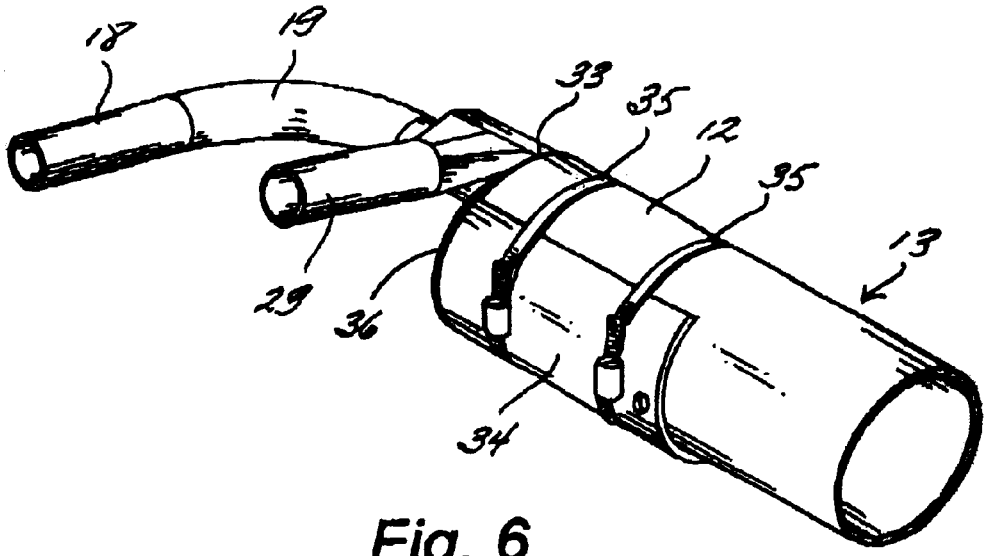
FIG. 6 is a perspective view similar to FIG. 5, showing the present invention assembled to a pair of slidably connected tubes.
Figure 7:
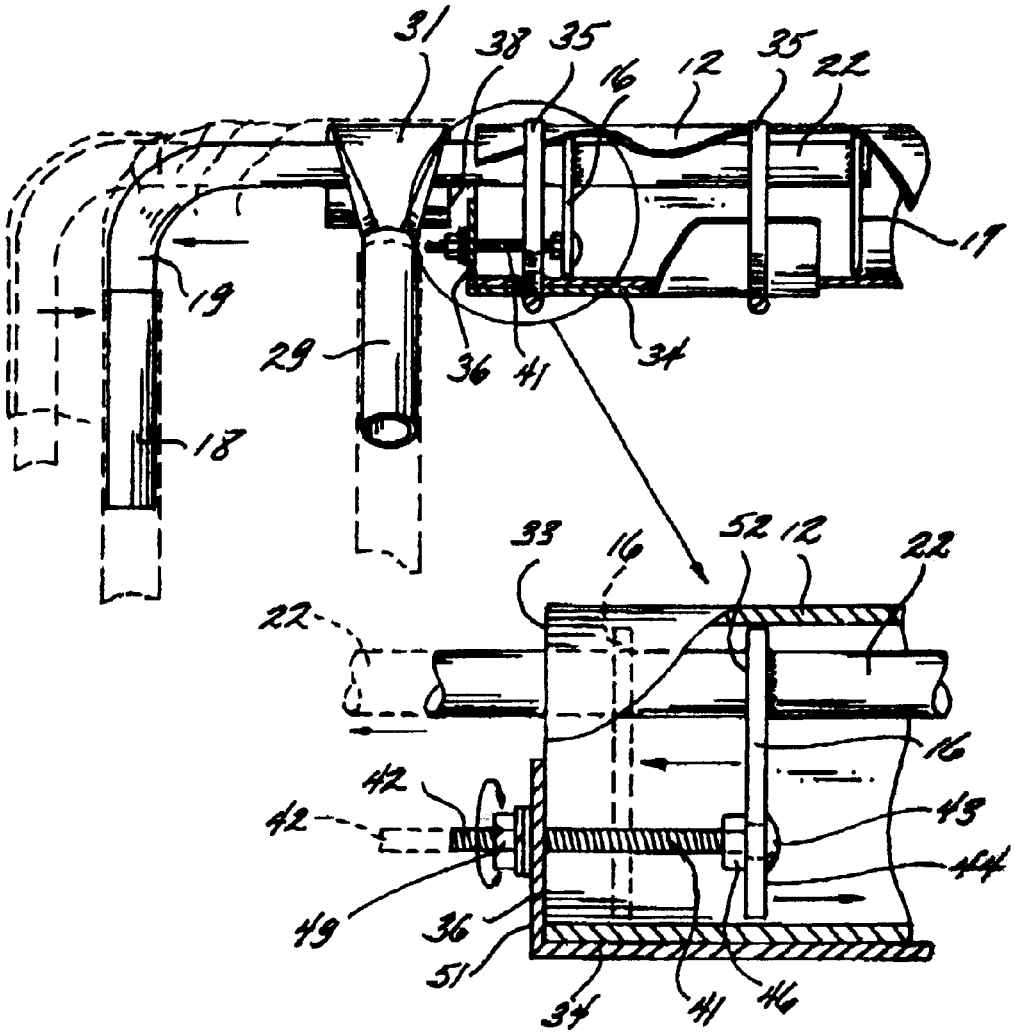
FIG. 7 is a composite side elevational view of the assembled invention of FIG. 6, partly in sectional and partly cut away for clarity of invention, and with an enlarged sectional view of a detail of the invention illustrating relative axial movement of a pair of slidably connected tubes.

The sleeve (34) embraces the side frame tube outer end (12) whereby the flange (36) extends over and covers the outer face (33) of the said outer end (12) (FIGS. 6 and 7). Clamping members (35) hold the sleeve onto the side frame tube outer end (12). It will be noted that due to the curved extent of the clamping end (31) of the bow element (29) being less than a full circle, and as the oval shape (FIG. 4) of the flange (36) is less than the diameter of the side frame tube outer end (12), both the clamping end inner edge (38) (FIG. 7) and the flange (36) may lie in the same plane against the side frame tube outer end face (33), under certain circumstances.

Figure 3:
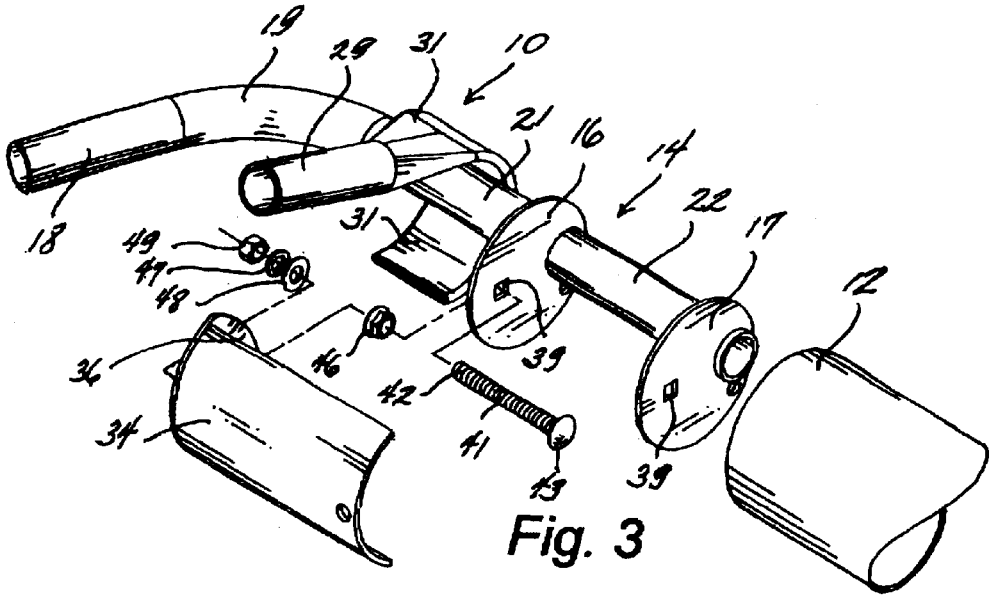
FIG. 3 is an enlarged, exploded view of the present invention, from one perspective.

In this position of the sleeve (34) and its flange (36), the opening (37) is axially and longitudinally aligned with an opening (39) formed in each spacer element (16), (17) (FIGS. 3 and 4), whereby a carriage bolt (41) may be inserted through the opening (39) in at least one spacer element (16), for example, with one end (42) of the bolt (41) also inserted through the flange opening (37), and with the enlarged head (43) of the bolt (41) engaged with the inner face (44) (FIG. 7) of the spacer element (16).

The bolt (41) is held in place against the spacer (16) by a lock nut (46) threaded onto the bolt (41) and against the outer face (52) of the spacer element (16). Lock washers (47), (48) (FIG. 7) are inserted over the bolt end (42), with an adjusting hex nut (49) threaded onto the bolt end (42).

Rotation of the adjusting nut (49) in one direction tends to tighten it against the outer face (51) of the flange (36), whereby continued rotation in the same direction of the nut (49) effects a slidable draw outwardly of the weldment tube outer end (22) (FIG. 7) relative to the side frame tube outer end (12) due to a jack screw action of the bolt (41) and nut (49), the flange (36) being held tight against the side frame tube outer end face (33). Rotation of the adjusting nut (49) in an opposite direction loosens the engagement relationship of the adjusting nut (49) with the flange (36), whereby the weldment tube outer end (22) and its spacers (16), (17) are slidably movable, as before, axially into the side frame tube outer end (12).

Although these axial adjustment movements of the side frame tube outer end (12) and the adjacent weldment tube end (22) may be, for example, only about a total of one and one half inches (1½"), this variance will normally allow the installation of a canopy cover over a framework, which canopy has either shrunk or was extra long. It will be appreciated that only the use of a simple open end wrench (not shown) or like tool for rotating the adjusting nut (49) is all that is required for rotation of the nut (49) to effect the framework adjustments described.

What is claimed is:

1. In a canopy assembly having a rectangular framework covered over by a canopy, the framework having at least one elongated, straight side tube with an outer end, and having at least one U-shaped elongated end tube with an outer straight end inserted axially into an adjacent outer end of a side tube, and with at least one spacer connected at right angles to said end tube outer end, said spacer also inserted within said side tube outer end, the improvement comprising:

first means attached to said framework and having a flange engaging a portion of said side tube outer end, said flange having an outer face;

second means including an externally threaded member inserted axially through said flange and said spacer, with an inner end of said member enlarged and held against the inside of said spacer relative to said flange, said threaded member having an outer end extended outwardly of said flange; and third means rotatably threaded onto said member outer end and threadably engageable with said flange outer face, rotation of said third means in one direction effective to slidably move said spacer and said end tube outer end axially outwardly of and relative to said side tube outer end, rotation of said third means in an opposite direction effective to loosen the engagement of said third means with said flange outer face.

2. The canopy assembly improvement of claim 1, and further wherein said flange is disposed at right angles to the longitudinal axis of said side tube outer end, said spacer including a relatively flat element disposed parallel to said flange outer face.

3. The canopy assembly improvement of claim 1, and further wherein said second means comprises a carriage-type bolt, with a locking nut threadably engaged with said bolt, said spacer having an outer face, said nut engaged with said spacer outer face.

4. The canopy assembly improvement of claim 1, and further wherein said third means comprises a nut threaded onto said threaded member outer end and axially movable thereon into and out of engagement with said flange outer face.

* * * * *